United States Patent [19]

Smejda

[11] 4,265,175

[45] May 5, 1981

[54] CENTRAL SUPPORT ARRANGEMENT FOR PRINTING SYSTEMS

[76] Inventor: Richard K. Smejda, 192 Edmund Ave., Paterson, N.J. 07502

[21] Appl. No.: 162,174

[22] Filed: Jun. 23, 1980

Related U.S. Application Data

[63] Continuation-in-part of Ser. No. 902,954, May 4, 1978, abandoned.

[51] Int. Cl.[3] ..... B41F 9/02; B41F 15/10; B41F 13/20; B41F 5/08

[52] U.S. Cl. ..... 101/115; 101/116; 101/152; 101/181

[58] Field of Search ..... 101/176, 177, 178, 179, 101/180, 181, 182, 183, 184, 185, 115, 116, 117–120, 152, 153; 118/258, 259, 126, 216, 407, 223, 224, 413; 68/202

[56] References Cited

U.S. PATENT DOCUMENTS

| | | | |
|---|---|---|---|
| 1,011,508 | 12/1911 | Smith | 101/178 |
| 1,855,525 | 4/1932 | MacArthur | 101/151 |
| 2,213,569 | 9/1940 | Rohland | 101/181 |
| 2,434,013 | 1/1948 | Ross | 101/423 X |
| 2,619,033 | 11/1952 | Lembo | 101/181 |
| 2,633,755 | 4/1953 | Bommelaer | 101/178 X |
| 2,962,962 | 12/1960 | Smith | 101/178 |
| 3,014,454 | 12/1961 | Smejda | 118/222 X |
| 3,026,798 | 3/1962 | Frostad | 101/178 X |

*Primary Examiner*—J. Reed Fisher
*Attorney, Agent, or Firm*—Weingram & Klauber

[57] ABSTRACT

A versatile system for printing on flexible sheets of material includes a center roller driving at least two backing rollers with an endless flexible blanket sleeve enveloping the backing rollers and urging the backing rollers inwardly against the center roller. The backing rollers are independently adjustable in selective positions about the circumference of the center roller and have selective diameter sizes independent of the other backing rollers. Feed and take up means provide a sheet of material around the rollers and blanket sleeve and printing devices are mounted against the sheet for printing thereon. The printing devices may be mounted at flexible web portions of the sheet and sleeve spaced from the backing rollers for printing on the flexible portion stretched between the rollers. The feed and take-up portions and roller and printing portions are separable to permit different roller and printing systems to be utilized while each system may include various printing devices such as rollers or stationary units.

9 Claims, 6 Drawing Figures

CENTRAL SUPPORT ARRANGEMENT FOR PRINTING SYSTEMS

This application is a continuation-in-part of application Ser. No. 902,954, filed May 4, 1978, which is now abandoned.

BACKGROUND OF THE INVENTION

1. Field of the Invention

The present invention relates to systems for printing on sheets of materials, such as fabric, and particularly to a system which can employ a plurality of different sized backing rollers at different positions around a common center drive roller and can utilize different printing devices at different locations.

2. Description of the Prior Art

Presently known printing systems utilize center gears a rollers to drive a plurality of printing rollers and intermediate or idler rollers. Endless belts or sleeves are formed around the intermediate and drive rollers and sheets of material are fed over the sleeve and rollers past outer printing rollers which apply liquids to the sheets for printing thereon. The intermediate rollers and printing rollers are generally at fixed locations and each set of rollers are of equal size diameters. Examples of such prior art systems are found in U.S. Pat. Nos. 2,213,569, 1,855,525, and 1,011,508, each of which utilize a plurality of identical printing or spaced intermediate rollers. While the latter patent mentions the use of cylinders of different diameters, these are all of the same size at one time and not different sizes used together. U.S. Pat. No. 2,633,755 shows a device for adjusting the position of drive wheels for printing rollers, but these are all of equal sizes and adjusted as a group rather than independently. Another adjustable printing apparatus is shown in U.S. Pat. No. 3,026,798 which permits angular adjustment of intermediate gears about a central cylinder, but the gears are likewise of the same size at all locations.

Various printing devices are also available for applying liquids to sheets of material or substrates which are fed over the contacting surfaces of the devices. These include rollers, as in the above mentioned patents, which rotate with a central driver roller and the moving sheet and stationary applicators which apply the liquids to the sheets as they pass against the surfaces of the applicators. Examples of the latter stationary devices are found in U.S. Pat. Nos. 3,014,454, and 4,133,293 of the present applicant. Generally only one type of printing device can be utlized in a particular printing system.

SUMMARY OF THE INVENTION

It is therefore the primary object of the present invention to provide a versatile printing system which may employ independently adjustable backing rollers at varying selective positions about a center roller and which may be of different size diameters.

A further object of the invention is to provide a printing system that can utilize different types of printing devices such as rollers of different sizes and stationary applicators.

A still further object of the invention is to provide a printing system having feed and take up means which are separable from the roller and printing portions to permit use of different roller and printing systems.

An additional object is to provide a printing system having printing devices that are mounted at flexible web portions of the sheet material spaced from the backing rollers to permit printing on the flexible portions stretched between the rollers.

Another object of the invention is to provide a printing system having backing rollers which fit squarely and are pressed against the drive roller within an endless blanket sleeve to avoid misalignment, deformation and vibration.

These objects are achieved with a novel printing system that includes a center roller driving at least two backing rollers within an endless blanket sleeve that urges the backing rollers inwardly against the center roller. Feed and take up means provide a flexible sheet of material around the blanket sleeve and rollers, with printing devices being arranged against the sheet. The printing devices may include rollers as well as stationary units in the same system and the devices may be mounted at flexible web portions of the sheet and sleeve spaced from the backing rollers for printing on the flexible portions stretched between the rollers. The individual backing rollers may have different diameter sizes and are independently adjustable in selective positions about the circumference of the center roller. The feed and take up portions are separable from the roller and printing portions to permit different roller and printing systems to be used. Other objects and advantages will become apparent from the following description in conjunction with the accompanying drawings.

DESCRIPTION OF THE PREFERRED EMBODIMENTS

Figure 1:
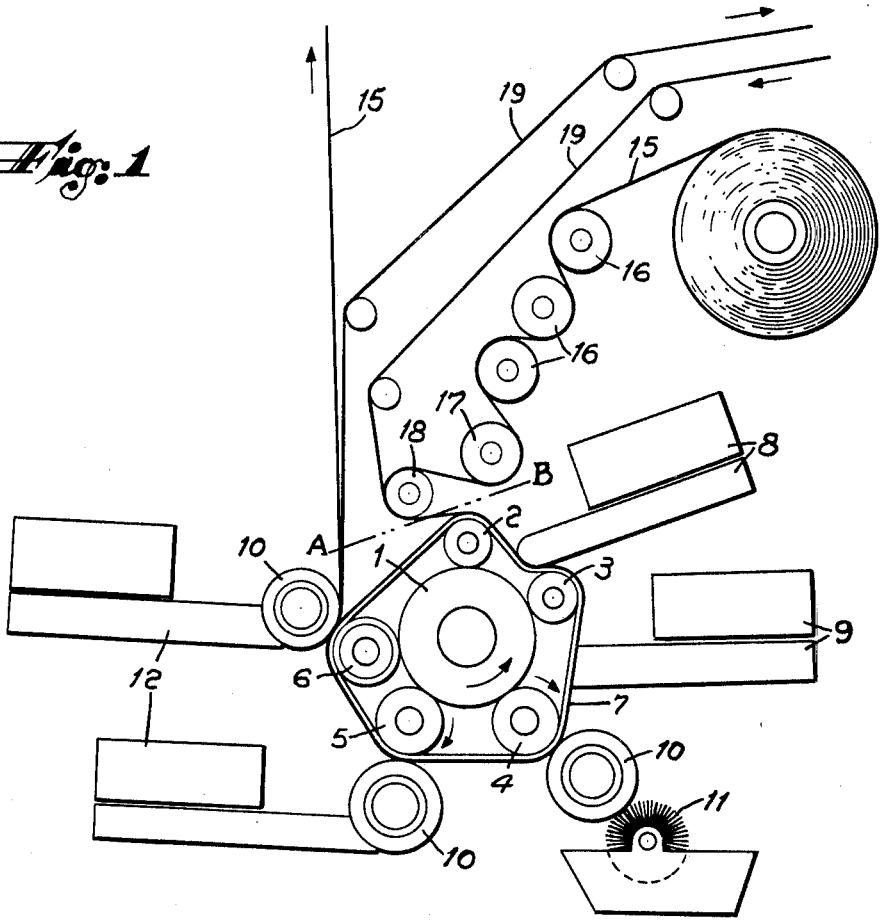
FIG. 1 is a schematic side view of a printing system including feed and take up mechanisms and the novel roller and printing devices of the present invention.

As shown in FIG. 1, a sheet of flexible material or substrate 15 is fed from a supply roll over driven rollers 16, bow expander 17 and scroll roller 18 to a flexible blanket sleeve 7. Sleeve 7 is stretched over and envelops a plurality of backing rollers 2, 3, 4, 5, and 6 of different selective diameter sized positioned at independently adjustable selective locations about a center driving roller 1. Center roller 1 rotates counterclockwise, while the contacting backing rollers and sleeve 7 rotate clockwise. The substrate material 15 to be printed on, such as fabric, is fed together with a backgrey intermediate fabric layer 19 over the first roller 2 and sleeve 7 past a first stationary liquid printing applicator 8, of a type described in the above mentioned prior art patents. The first printing area is at a selective location stretched between rollers 2 and 3 and is thus a semi-soft or semi-hard area of the sleeve 7. The softest contact point would be at the area most remote from the roller, as the sleeve is suspended freely at that location, while the hardest point would be at the area backed by the rollers, with some variation determined by the flexibility of the materials. Printing applicator 9 is at a similar soft location between rollers 3 and 4 and operates directly against the substrate in a sliding or wiping fashion without the hard backing of the rollers. Conventional intaglio rollers 10 are positioned adjacent to the hard backing rollers 4, 5 and 6, with the first roller 10 used in conjunction with a brush until 11, while the other rollers 10 are used with multicolor units 12. Such multicolor units may apply up to eight different colors per inch of substrate material permitting almost unlimited color variations.

Many variations may also be made in the number, size, and location of the backing rollers as well as the printing rollers and units. Thus, roller 2 is the smallest diameter, rollers 3 and 6 of intermediate size, and rollers 4 and 5 of the largest size. The backing rollers and sleeve may also have different surface hardnesses and textures for various applicators. The backing rollers may also be geared to the center drive roller 1 or may be driven by friction. The uniformity of the speed of sleeve 7, which rotates in a clockwise direction, is controlled by the uniform surface speed of center roller 1 as the driving element and by the unifying contact of sleeve 7 around the outer surfaces of the backing rollers. Bearing pressure is exerted on the shafts of the backing rollers toward the center roller to provide frictional force between the contacting surfaces, with the tight fit of the sleeve, which has a tendency to shrink, further urging the rollers inward toward the center. The plurality of rollers reinforce each other and prevent distortion or deflection of any individual roller or the entire assembly. This obviates the need for corrective contact pressure as previously required in printing machines and permits use of engraved intaglio rollers with low contact pressure and use of slip-on needle or ball bearings with greater accuracy and economy of operation. Resulting compactness and reduced deflection permits use of large operating widths. Larger numbers of smaller sized backing rollers can be used efficiently with a center roller in proportion to its size. The dashed line A-B in FIG. 1 represents the dividing line of the feed and take up portions of the printing system, which can be separated from the roller and printing portions to permit other combinations of printing and roller units to be utilized with the same feed and take up elements.

Figure 2:
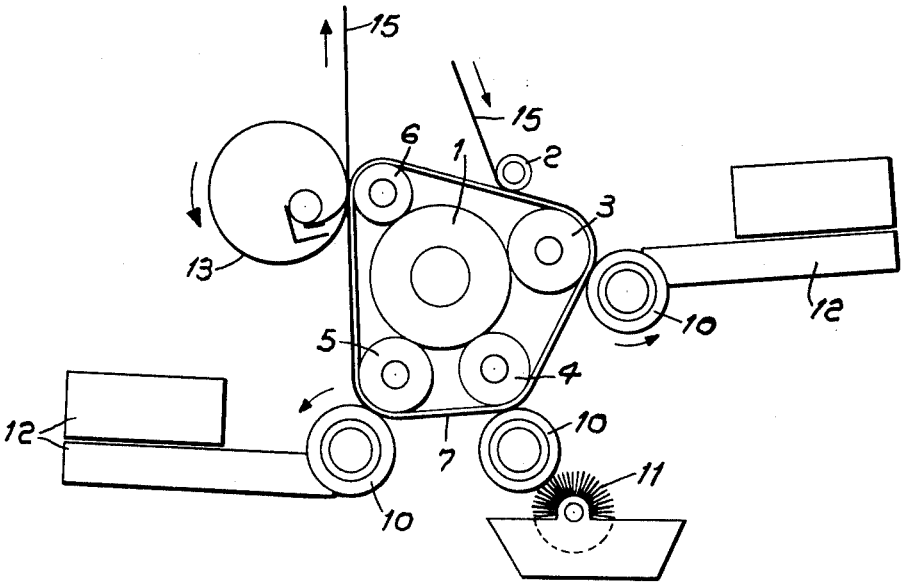
FIG. 2 is a schematic side view of another arrangement of the roller and printing device portion in accordance with the present invention.
Figure 3:
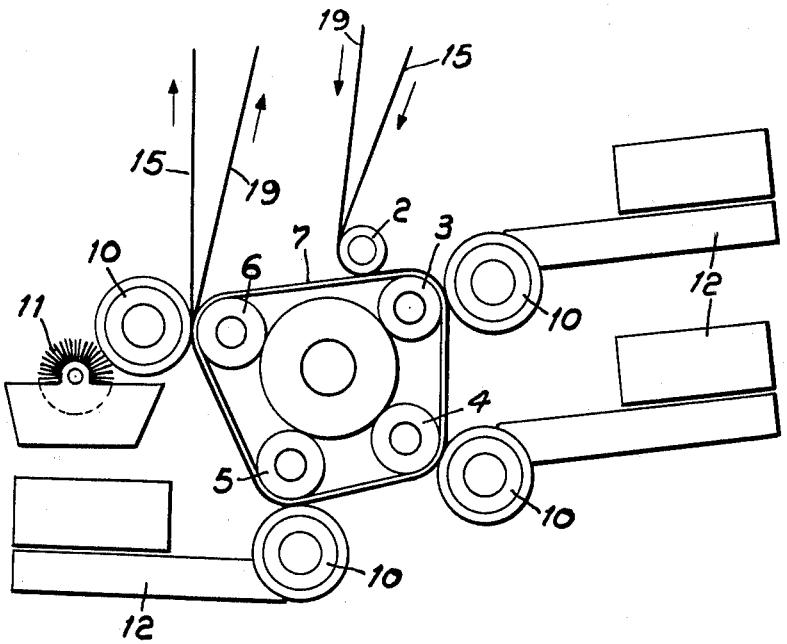
FIG. 3 is a further variation of the roller and printing devices of the present invention.

FIGS. 2 and 3 show examples of such other roller and printing combinations. Backing roller 2 in these cases, is removed from the position within the sleeve in contact with the center roller 1 and is now used as a feed roller for the sheet of material 15. Only four backing rollers 3, 4, 5 and 6 are now in direct contact with the center roller 1 and within sleeve 7 at different locations and of different sizes than in FIG. 1. The printing applicators 11 and 12 and rollers 10 are also at different locations and a different rotary screen printing unit 13 is now employed to contact the material at the flexible portion of sleeve 7 spaced from backing roller 6 in FIG. 2. The circumference of the rotary screen may be a multiple of the intaglio rollers if exact registration is desired, or a random value if registration is not required. FIG. 3 utilizes another variation having four engraved rollers 10 supplied by three multicolor units 12 and a brush unit 11 supplying either one color or being used as a crush roller. All of the rollers in this case print on hard surfaces of the material against the backing rollers rather than an intermediate sleeve portion. The various selected positions and diameters of the rollers in FIGS. 1 through 3 indicate different combinations that can be employed for better utilization of space, improved angles of application, or improved contact.

Figure 4:
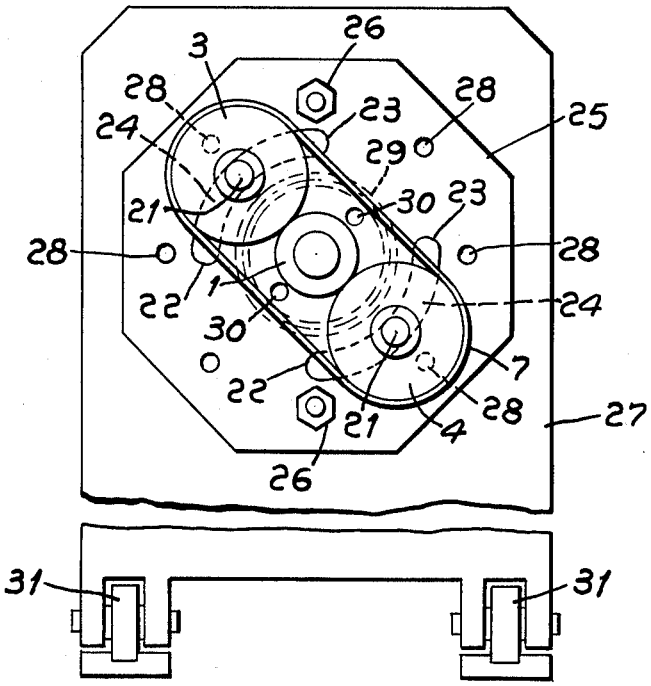
FIG. 4 is a schematic side view, with plates at one end removed, showing a mechanism for varying the position of the rollers of the present invention.
Figure 5:
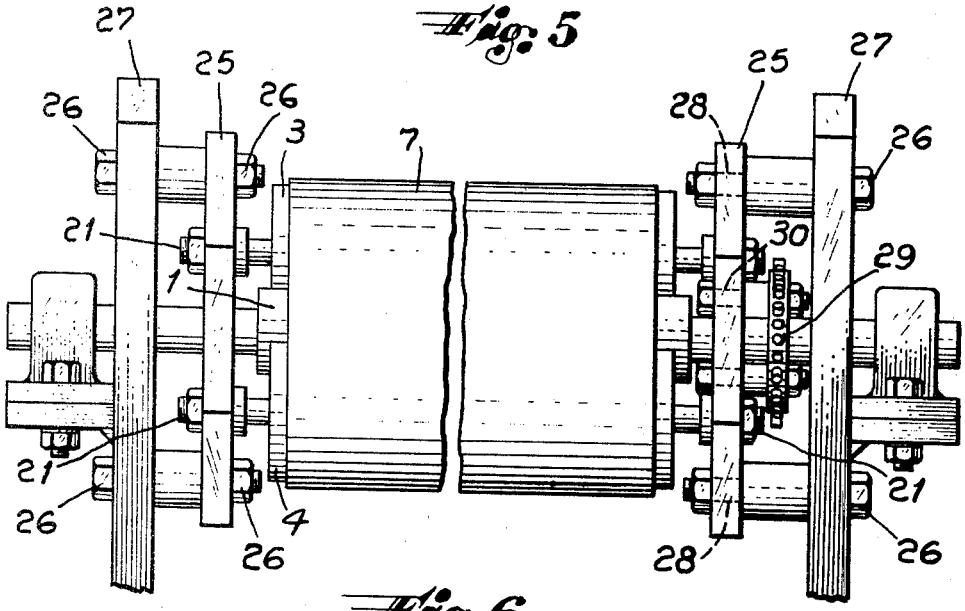
FIG. 5 is a schematic partial front view of the mechanism of FIG. 4.

As shown in FIGS. 4 and 5, using only two backing rollers 3 and 4 about a center driving roller 1 for simplification, the positions of the backing rollers can be independently varied up to 45° in either direction within slots 24 in octagonal plate 25. The rollers can be moved into position at the ends 22, 23 of each slot 24 or anywhere in between. The horizontal and vertical position of sleeve 7 is adjusted accordingly. The shafts 21 of the rollers are moved within the slots and then locked in the selected position on plate 25 by means of locking nuts. Two plates 25 support the backing roller shafts at each end and are also rotatable about the common center shaft of center roller 1 which is supported in two fixed end plates 27. The position of plates 25 can be set at any of eight locations by means of a series of holes 28 in a circular path on each plate 25. Two bolts 26 are inserted into the selected holes and secured to plates 27 by locking nuts and spacers between plates 25 and 27 to fix the position of the plates 25, sleeve 7, and rollers.

Plates 25 also support the drive mechanism for the rollers and the various selected printing devices, so that fixing of the position of the plates establishes the position of all of the printing elements and the entire system for operation of the printing machine. After completion of a particular production run, the bolts 26 may be removed to free plates 25 for rotation into another position. This may be done by use of a motor in conjunction with a drive sprocket 29, which is normally used for driving center roller 1. The sprocket drive may be bolted to plate 25 through bores 30 to permit the motor to slowly turn plate 25 together with fixed rollers 3 and 4 and the connected printing devices to any selected position about center roller 1. Bolts 26 are then inserted into a pair of bores 28 to lock the system in the desired position. The bolts are then removed from bores 30 to permit the sprocket to drive center roller 1 in the normal printing operation. Backing rollers 3 and 4 preferably rotate about shafts 21 on internal bearings, while center roller 1 has a shaft which rotates in bearings supported on plates 27.

Figure 6:
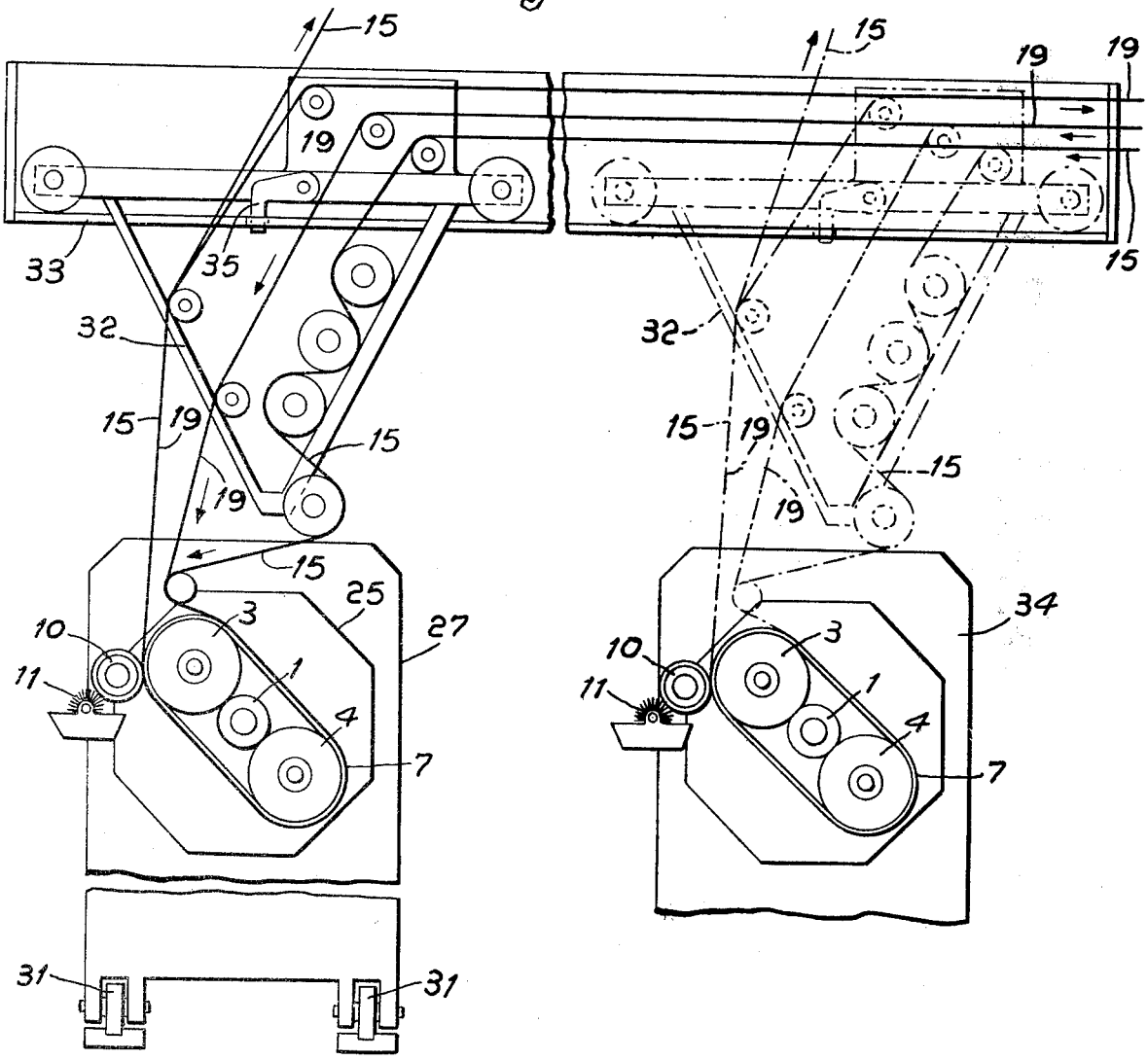
FIG. 6 is a schematic side view showing the use of a movable printing and roller system with a movable feed and take up system.

Endplates 27 also have pairs of wheels 31 mounted at the bottoms of each end in rails to permit removal of the entire printing portion of the machine from the feed and take up portion above line A-B, as indicated in FIG. 1. A second printing unit, which has previously been made ready, can then be moved into position for another operation with the same feed and take up arrangement. This interchangeability of different printing units permits more continuous and efficient operation of the supply and drying systems without the usual long change over times customary in textile printing. In a further variation shown in FIG. 6, a common take up and feed system and drying unit, (not shown), can be used two different printing systems by moving the take up and feed system supported on a carriage 32 along an overhead rail 33 to a position over a parallel second stationary printing system 34. A stop device 35 holds the carriage 32 in the desired position on rail 33. The present invention thus provides a novel, versatile printing system which can accommodate many different devices at different positions. While a limited number of embodiments have been illustrated and described, it is apparent that many other variations may be made in the particular designs and configurations without departing from the scope of the invention as set forth in the appended claims.

What is claimed is:

1. A printing system comprising:

a center drive roller mounted for rotation in a given direction, a plurality of backing rollers mounted around and in contact with said center roller and driven in the opposite direction, means for independently adjusting the position of each of said backing rollers in selective positions about the circumference of said center roller, an endless flexible blanket sleeve stretched around and enveloping and rotating with said backing rollers to urge said backing rollers into contact with said center roller, and printing means mounted at selective positions about said blanket sleeve and adapted to print on a substrate material passing between said blanket sleeve and printing means.

2. The printing system of claim 1 including feed and take up means supplying said substrate material around said blanket sleeve.

3. The printing system of claim 2 wherein each backing roller is of a selective diameter size independent of the other backing rollers.

4. The printing system of claim 3 wherein said printing means are mounted adjacent flexible portions of said blanket sleeve spaced from said backing rollers for printing on flexible portions of said substrate material.

5. The printing system of claim 3 wherein said printing means includes a plurality of independent printing devices mounted at spaced positions about said blanket sleeve.

6. The printing system of claim 5 wherein said printing devices include stationary applicators and roller applicators.

7. The device of claim 3 wherein said feed and take up means are separable from said printing means and rollers and sleeve.

8. The device of claim 3 including means for adjusting the position of the combined backing rollers, center roller, and sleeve at selective locations in a 360 degree circle about the shaft of the center roller, and means for securing said rollers and sleeve in said selective locations.

9. The device of claim 7 including means for moving said feed and take up means into another position for connection to another group of rollers, sleeve, and printing means.

* * * * *